US010724293B1

(12) United States Patent
Staton et al.

(10) Patent No.: US 10,724,293 B1
(45) **Date of Patent: *Jul. 28, 2020**

(54) LIGHTED DOOR WITH GROOVE AND FLANGED LIGHTING DEVICE TO BE INSERTED THEREIN

(71) Applicant: NEWTONOID TECHNOLOGIES, L.L.C., Liberty, MO (US)

(72) Inventors: Fielding B. Staton, Liberty, MO (US); David Strumpf, Columbia, MO (US)

(73) Assignee: NEWTONOID TECHNOLOGIES, L.L.C., Liberty, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/543,163

(22) Filed: Aug. 16, 2019

Related U.S. Application Data

(63) Continuation-in-part of application No. 16/355,149, filed on Mar. 15, 2019.

(60) Provisional application No. 62/764,972, filed on Aug. 16, 2018, provisional application No. 62/644,215, filed on Mar. 16, 2018.

(51) Int. Cl.

| | |
|---|---|
| ***E06B 7/28*** | (2006.01) |
| ***F21S 8/00*** | (2006.01) |
| ***E06B 3/70*** | (2006.01) |
| ***F21V 33/00*** | (2006.01) |
| ***F21V 23/04*** | (2006.01) |
| *F21Y 115/10* | (2016.01) |
| *E06B 5/00* | (2006.01) |

(52) U.S. Cl.
CPC ..... *E06B 7/28* (2013.01); *E06B 3/70* (2013.01); *F21V 23/0442* (2013.01); *F21V 33/006* (2013.01); *E06B 5/003* (2013.01); *E06B 2003/7046* (2013.01); *F21Y 2115/10* (2016.08)

(58) Field of Classification Search
CPC ..... F21V 33/0016
USPC ..... 362/16
See application file for complete search history.

(56) References Cited

U.S. PATENT DOCUMENTS

| | | | | |
|---|---|---|---|---|
| D226,261 | S | 2/1973 | Horgan | |
| D226,556 | S | 3/1973 | Horgan | |
| D226,654 | S | 4/1973 | Horgan | |
| 4,293,894 | A * | 10/1981 | Blank | E05B 17/10 362/100 |

(Continued)

OTHER PUBLICATIONS

Screen Capture of YouTube video clip entiled "Wright Products VLED Door Light"; 4 Page, uploaded Aug. 10, 2016 by Wright Products. Retrieved from Internet: <https://www.youtube.com/watch?v=NrTrrtBd-AI> (Year: 2016).*

(Continued)

*Primary Examiner* — Evan P Dzierzynski
*Assistant Examiner* — Keith G. Delahoussaye
(74) *Attorney, Agent, or Firm* — Avant Law Group, LLC

(57) ABSTRACT

A lighted door system includes a door having a frame defining a hinge side, an opposite distal side, a top, and a bottom. The frame has a front face, a back face, and inside face, an outside face, and a groove formed in at least one of the front face, the back face, the inside face, and the outside face. At least one lighting device is coupled to the door frame. The at least one lighting device includes a housing and a flange extending from the housing. The flange is received into the groove in the door frame to couple the at least one lighting device to the door frame.

18 Claims, 12 Drawing Sheets

(56) References Cited

U.S. PATENT DOCUMENTS

| | | | | | |
|---|---|---|---|---|---|
| 4,309,744 | A * | 1/1982 | Catanese | F21S 8/033 | 362/147 |
| 4,757,430 | A * | 7/1988 | Dubak | F21S 8/035 | 361/175 |
| 4,872,095 | A * | 10/1989 | Dubak | F21V 23/0442 | 362/100 |
| 5,032,957 | A * | 7/1991 | Canfield | A47B 81/00 | 362/133 |
| 6,439,732 | B1 * | 8/2002 | Weisbach | E05B 17/10 | 362/100 |
| 6,655,811 | B2 * | 12/2003 | Weisbach | E05B 17/10 | 362/100 |
| D501,565 | S | 2/2005 | Malicki | | |
| D583,565 | S | 12/2008 | Colston | | |
| 8,021,012 | B2 * | 9/2011 | Dunbar | F21V 23/0414 | 200/60 |
| 8,474,993 | B2 * | 7/2013 | Williamson | F21S 9/032 | 362/100 |
| 2002/0131264 | A1 * | 9/2002 | Weisbach | E05B 17/10 | 362/100 |
| 2006/0133097 | A1 * | 6/2006 | Doric | F21V 21/28 | 362/401 |
| 2008/0013303 | A1 * | 1/2008 | Guarino | E06B 7/28 | 362/145 |
| 2010/0289434 | A1 * | 11/2010 | Dunbar | F21L 4/005 | 315/320 |
| 2010/0315008 | A1 * | 12/2010 | Williamson | F21S 9/032 | 315/152 |
| 2016/0174733 | A1 * | 6/2016 | Cinici | A47F 3/001 | 312/128 |
| 2018/0065550 | A1 * | 3/2018 | Brusco | B60Q 1/442 | |
| 2018/0164031 | A1 * | 6/2018 | Lee | F25D 23/02 | |
| 2018/0217229 | A1 * | 8/2018 | Shukla | H04B 10/502 | |
| 2018/0258695 | A1 * | 9/2018 | Earles | F21V 33/006 | |

OTHER PUBLICATIONS

U.S. Appl. No. 16/355,149, Non-Final Office Action dated Oct. 7, 2019, 25 pages.

Screen Capture of YouTube video clip entitled Wright Products VLED Door Light; 4 page, uploaded Aug. 10, 2016 by Wright Products. Retrieved from Internet: <https://www.youtube.com/watch?v=NrTrrtBd=AI> (Year: 2016).

* cited by examiner

LIGHTED DOOR WITH GROOVE AND FLANGED LIGHTING DEVICE TO BE INSERTED THEREIN

CROSS-REFERENCE TO RELATED APPLICATIONS

This application is a continuation-in-part of U.S. Patent Application No. 16/355,149, filed Mar. 15, 2019, which is pending and claims priority to U.S. Provisional Patent Application No. 62/644,215, filed Mar. 16, 2018. This application also claims priority to U.S. Provisional Patent Application No. 62/764,972, filed Aug. 16, 2018. The disclosure of each of these documents is incorporated by reference herein in its entirety.

BACKGROUND

Lights are often provided on a surface of a building to illuminate the entrance for visitors. In residential settings, this may include light fixtures near the garage doors and doors. In some instances, the light fixtures may be equipped with motion sensors such that the lights are switched on, or switched to a higher intensity, when movement is detected. While lighting near a door may generally illuminate the area around the door, the door itself often remains in the dark. Systems and methods for illuminating doors are described herein.

SUMMARY

The following presents a simplified summary of the invention in order to provide a basic understanding of some aspects of the invention. This summary is not an extensive overview of the invention. It is not intended to identify the critical elements of the invention or to delineate the scope of the invention. Its sole purpose is to present some concepts of the invention in a simplified form as a prelude to the more detailed description that is presented elsewhere herein.

In one embodiment, a lighted door system includes a door and a lighting device. The door has a hinge side, an opposite distal side, a top, and a bottom that defines an outer perimeter. The outer perimeter has an interior surface and an exterior surface and defines a cutout area within the door. The first lighting device is positioned at the interior surface of the outer perimeter of the door.

According to another embodiment, a lighted door system includes a first door, a second door, and a lighting device. The first door has a hinge side, an opposite distal side, a top, and a bottom defining an outer perimeter. The outer perimeter has an interior surface and an exterior surface and defines a cutout area within the first door. The second door has an outside surface offset from the interior surface of the first door which defines a space between the first door and the second door. The lighting device is positioned at the interior surface of the outer perimeter of the door in the space between the first door and the second door.

In still another embodiment, a method is provided for lighting a space between an outer door and an inner door. An outer door is provided and is hingedly connected to a door jamb, the outer door comprising a hinge side, an opposite distal side, a top, and a bottom defining an outer perimeter. An inner door is provided and is hingedly connected to the door jamb defining a space between the outer door and the inner door. A lighting device is positioned at the outer perimeter of the outer door in the space between the outer door and the inner door. The lighting device comprises an angled light-emitting surface, the angle being about forty-five degrees. Finally, the lighting device is selectively activated to illuminate the space between the outer door and the inner door.

According to a further embodiment, a lighted door system includes a door having a frame defining a hinge side, an opposite distal side, a top, and a bottom. The frame has a front face, a back face, and inside face, an outside face, and a groove formed in at least one of the front face, the back face, the inside face, and the outside face. At least one lighting device is coupled to the door frame. The at least one lighting device includes a housing and a flange extending from the housing. The flange is received into the groove in the door frame to couple the at least one lighting device to the door frame.

In still another embodiment, a lighted door system includes a first door having a frame and at least one lighting device fixed to the first door frame; and a second door having a frame and at least one lighting device fixed to the second door frame. The first door and the second door are spatially separated, and the lighting device fixed to the first door is communicatively coupled to the lighting device fixed to the second door.

According to still yet another embodiment, a method for lighting an area near a door includes (1) providing a door having a frame defining a hinge side, an opposite distal side, a top, and a bottom; (2) positioning at least one lighting device at the door frame; and (3) selectively activating the lighting device to illuminate the area near the door.

WRITTEN DESCRIPTION

Figure 9:
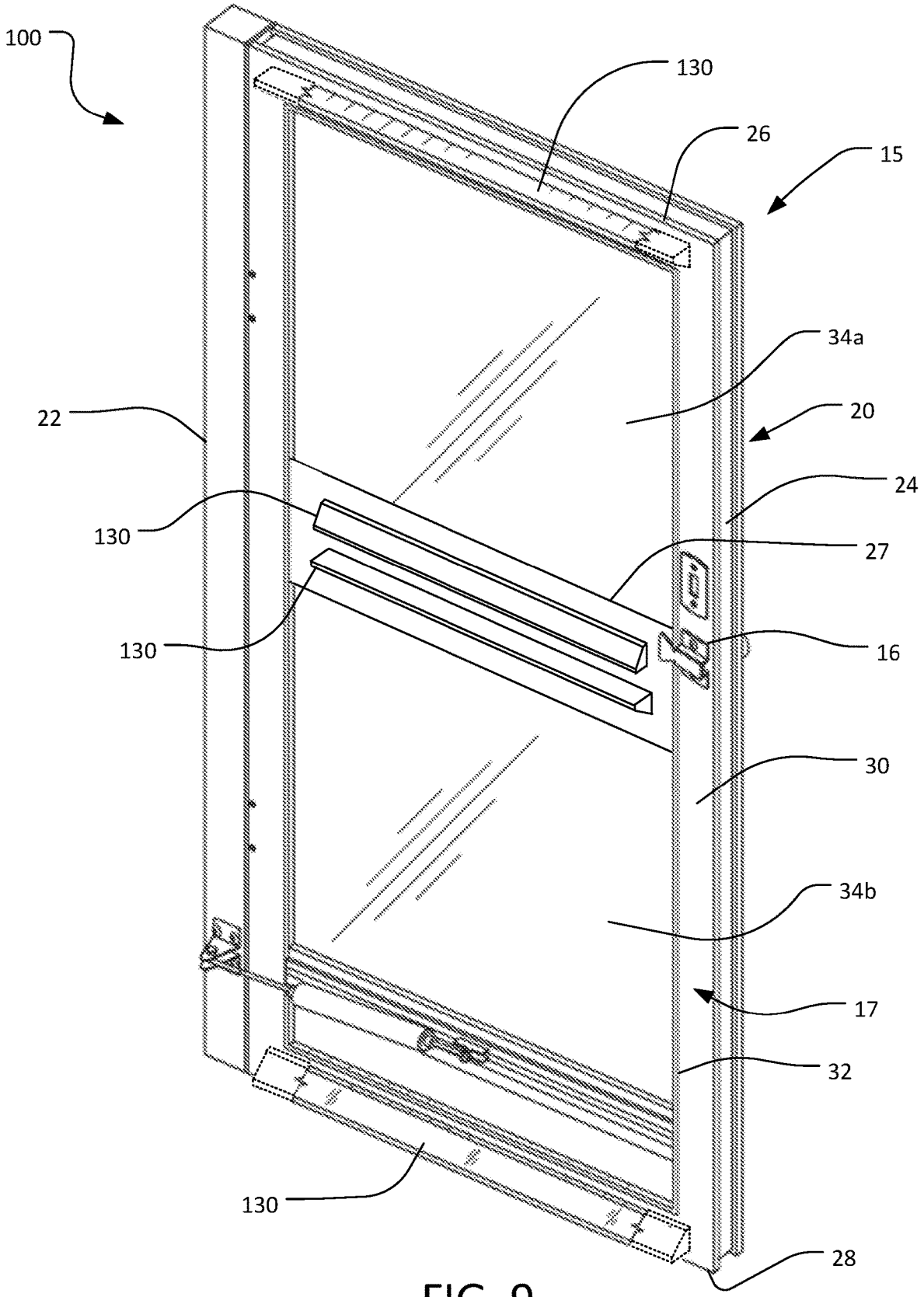
FIG. 9 is a perspective view of an inside surface of a door having a central rail with lighting devices disposed thereon according to an embodiment of the invention.
Figure 10:
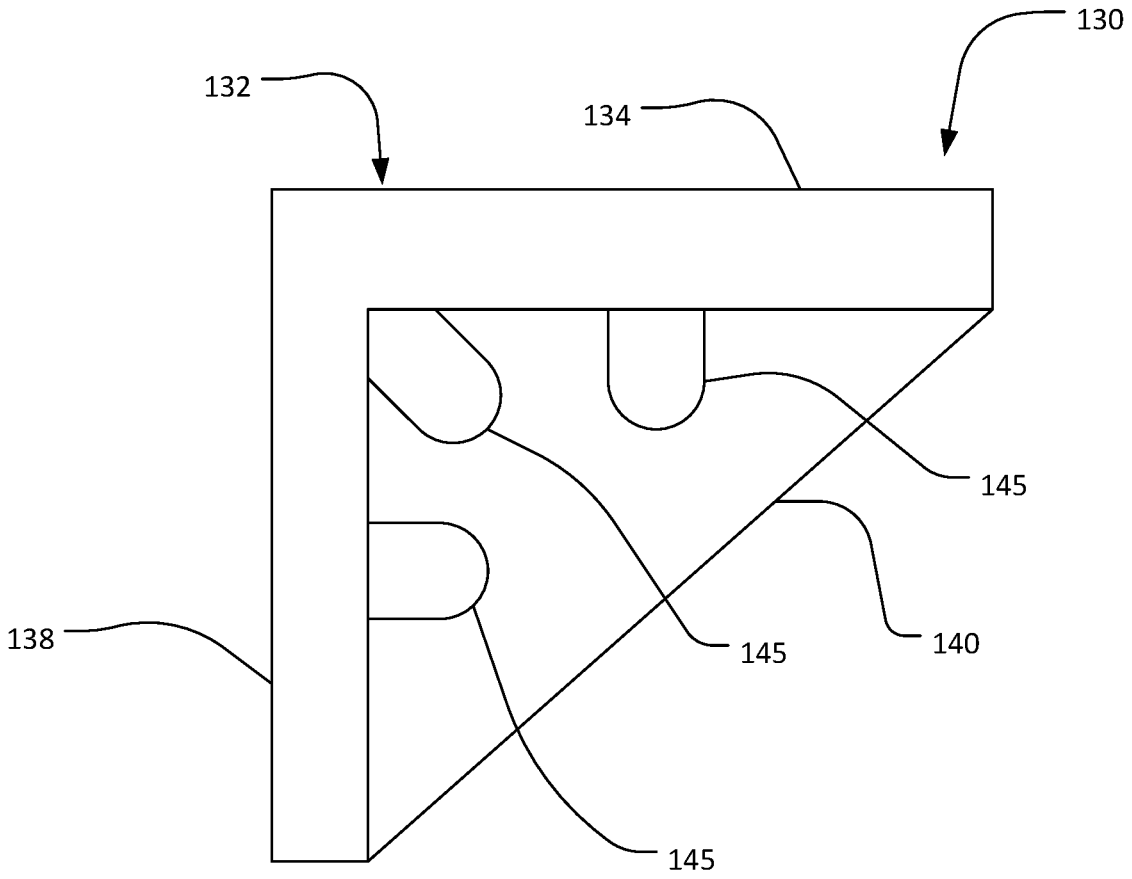
FIG. 10 is a cutout side view of a lighting device according to an embodiment of the invention.
Figure 11:
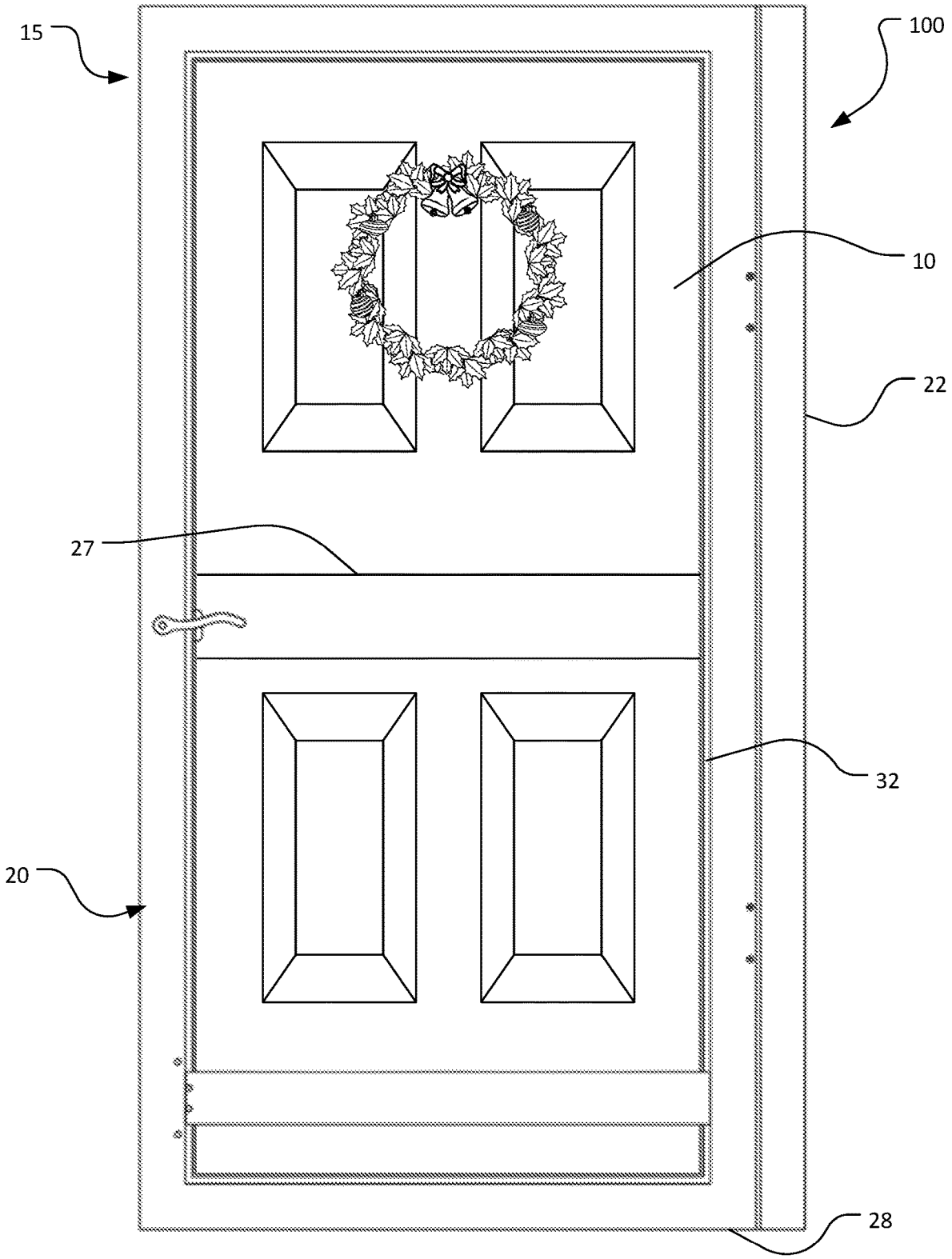
FIG. 11 is a front view of a door system showing an outside surface of an inner door, and an outside surface of an outer door with the lighting devices disposed therebetween according to another embodiment of the invention.

FIGS. 1-11 illustrate various embodiments of a lighted door system 100. Generally, the system 100 includes a door 15, and at least one lighting device 130. The door 15 includes an inside surface 17 and an outside surface 20. The door 15 has a hinge side 22, an opposing distal side 24, a top 26, and a bottom 28 forming an outer perimeter 30. The door 15 may optionally include a cutout 32 in a central area 34 of the door 15. A transparent panel 36 may be disposed within the cutout 32 allowing one to see through the door 15, such as shown in FIG. 11. The door 15 may, but need not necessarily, be an outer door, such as a storm door. In an embodiment, the door 15 is an outer (e.g., storm) door positioned outside of an inner ingress door 10. Both the ingress door 10 and the outer door 15 are hingedly connected to a door jamb. The inside surface 17 of the outer door 15 is slightly offset from an outside surface of the ingress door 10 (FIG. 11) defining a space between the outer door 15 and the ingress door 10.

Referring now to FIG. 10, one or more lighting devices 130 are positioned at the outer perimeter 30 of the door 15. Each lighting device 130 has a housing 132 and a light-emitting surface 140. The housing 132 includes two legs 134 and 138 generally configured in an "L", and the light-emitting surface 140 extends at an angle between the legs 134 and 138. The angle of the light-emitting surface 140 may be angled between about 0 and 90 degrees from the door 15. More preferably, the light-emitting surface 140 may be angled between about 30 and 75 degrees from the door. In one embodiment, the light-emitting surface 140 is angled between about 40 and 50 degrees from the door. In another embodiment, the light-emitting surface is angled about 45 degrees from the door.

Lights 145 are distributed in the housing behind the light-emitting surface 140. The lights 145 are preferably LED lights, but other lights may be used. The lights 145 may be positioned within the housing 132 at an angle, and specifically, at about a 45-degree angle from the door 15. The lights 145 may alternately extend perpendicularly from one, or both, legs 134 and/or 138 of the housing 132. The lights 145 may be single color, or multi-color, or a combination of single color and multi-color.

The lighting device 130 is secured to the door 15 such that the light-emitting surface 140 faces towards the central area 24 of the door 15. When the lights 145 are on, the central area 24 of the door 15 is illuminated. If the lighting device 130 is secured to an outer door, such as a storm door, the lighting device 130, when activated, also illuminates the inner door (e.g., an exterior door) 10. Additionally, any item that may be located in the space between the inner door 10 and the exterior door 15 may also be illuminated, such as a wreath or other ornamentation.

Figure 1:
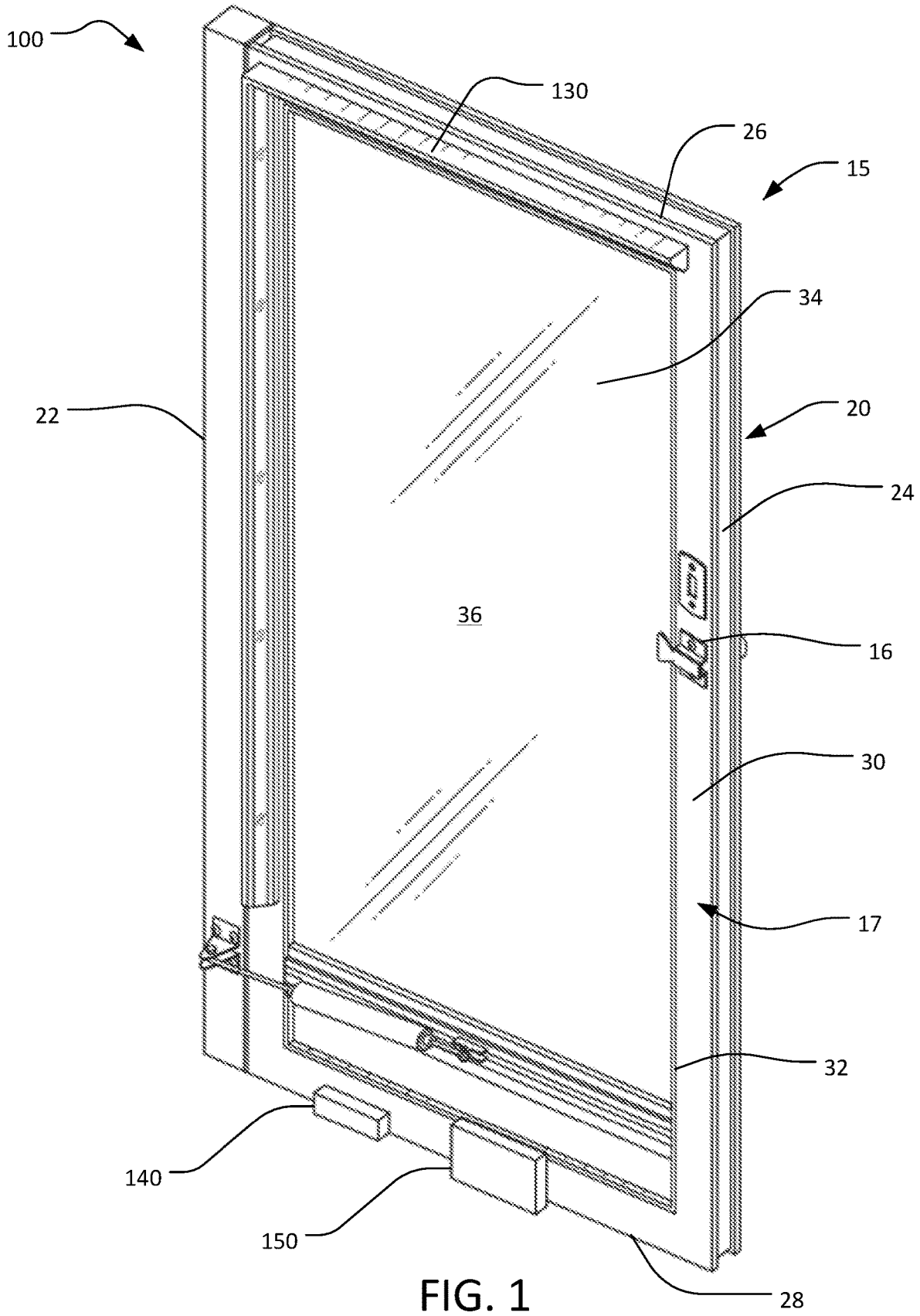
FIG. 1 is a perspective view of an inside surface of a door having a lighting device attached thereto according to an embodiment of the invention.
Figure 2:
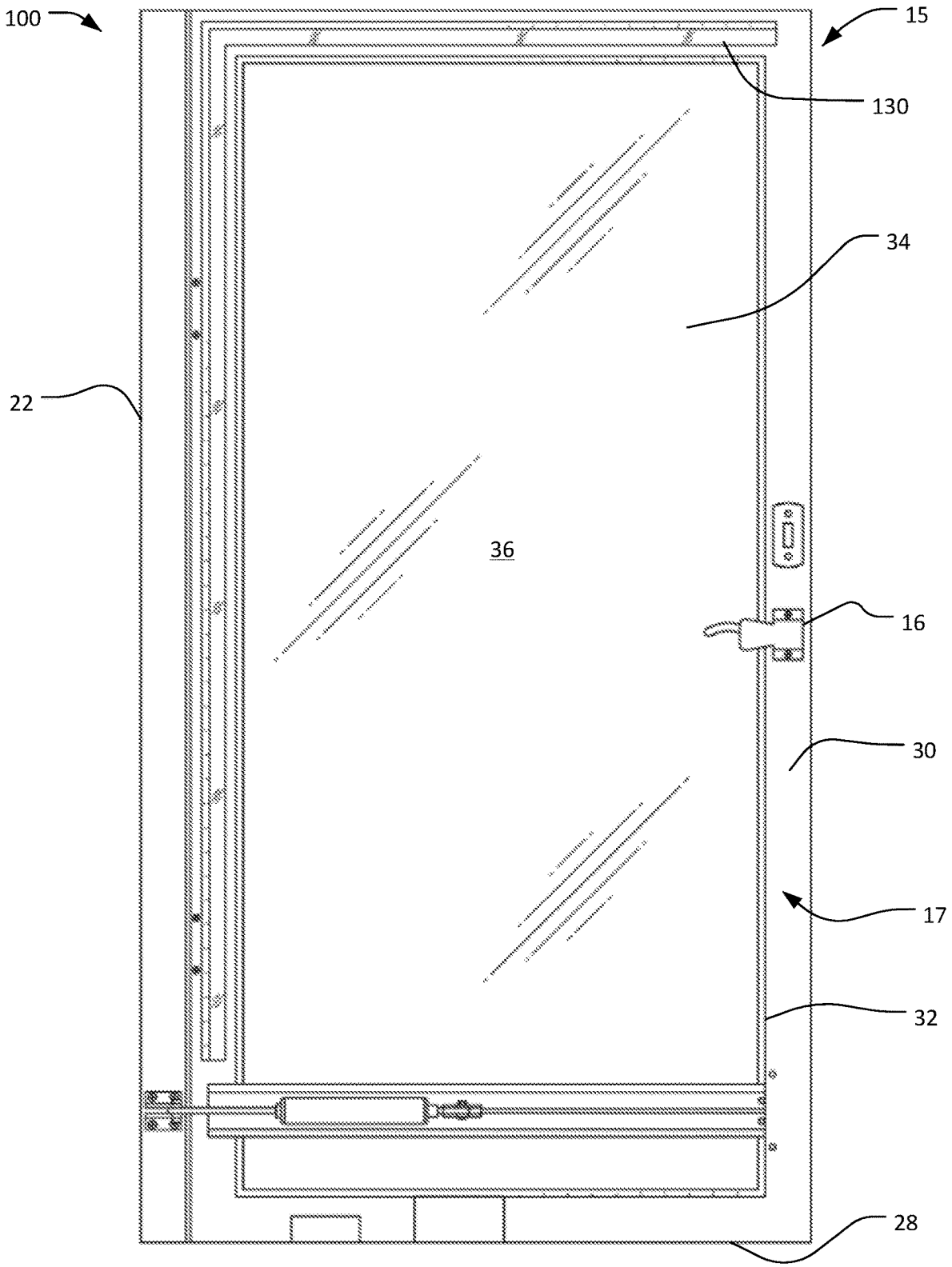
FIG. 2 is a front view of the inside surface of the door of FIG. 1.
Figure 3:
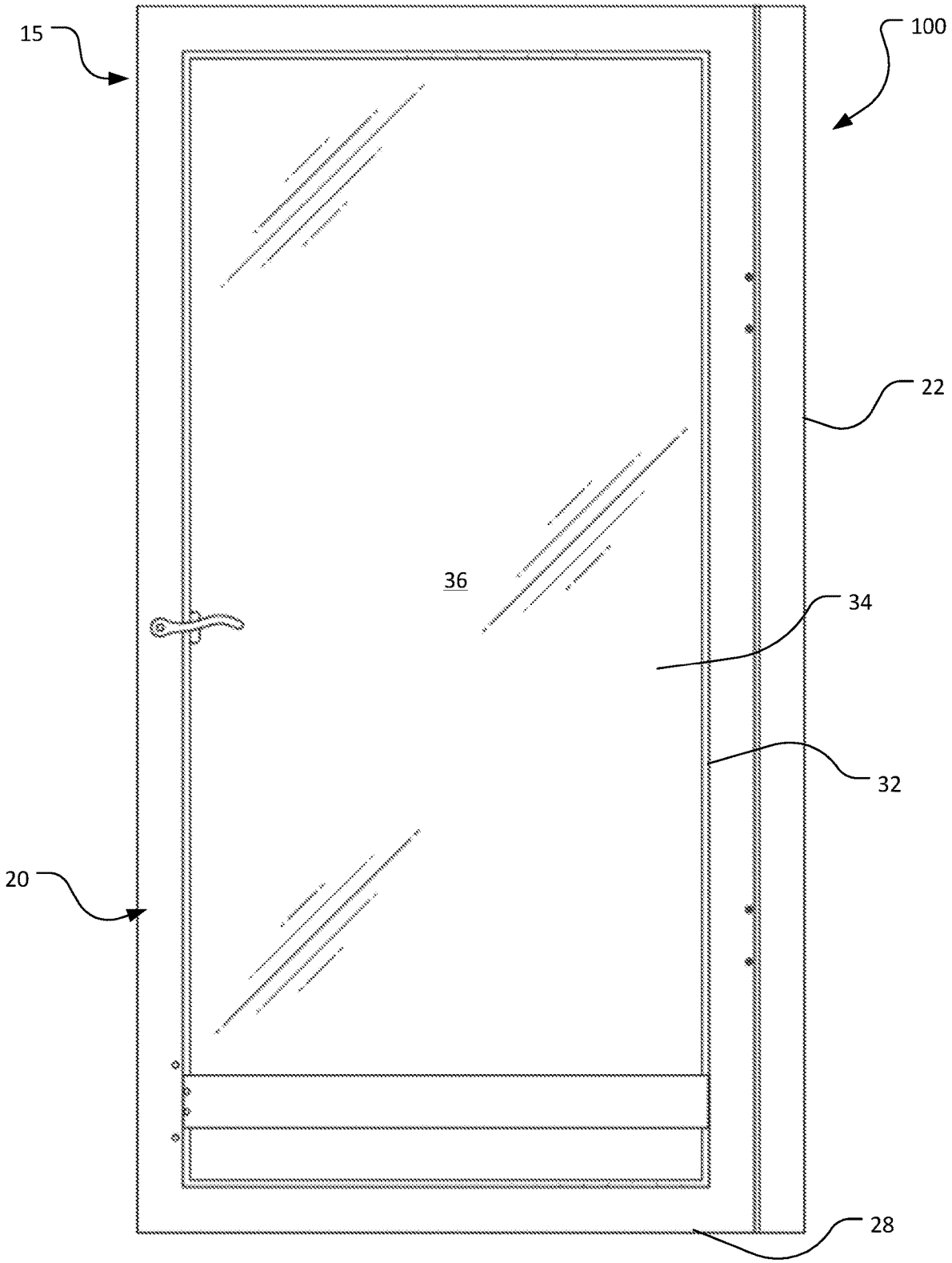
FIG. 3 is a back view of an outside surface of the door of FIG. 1
Figure 4:
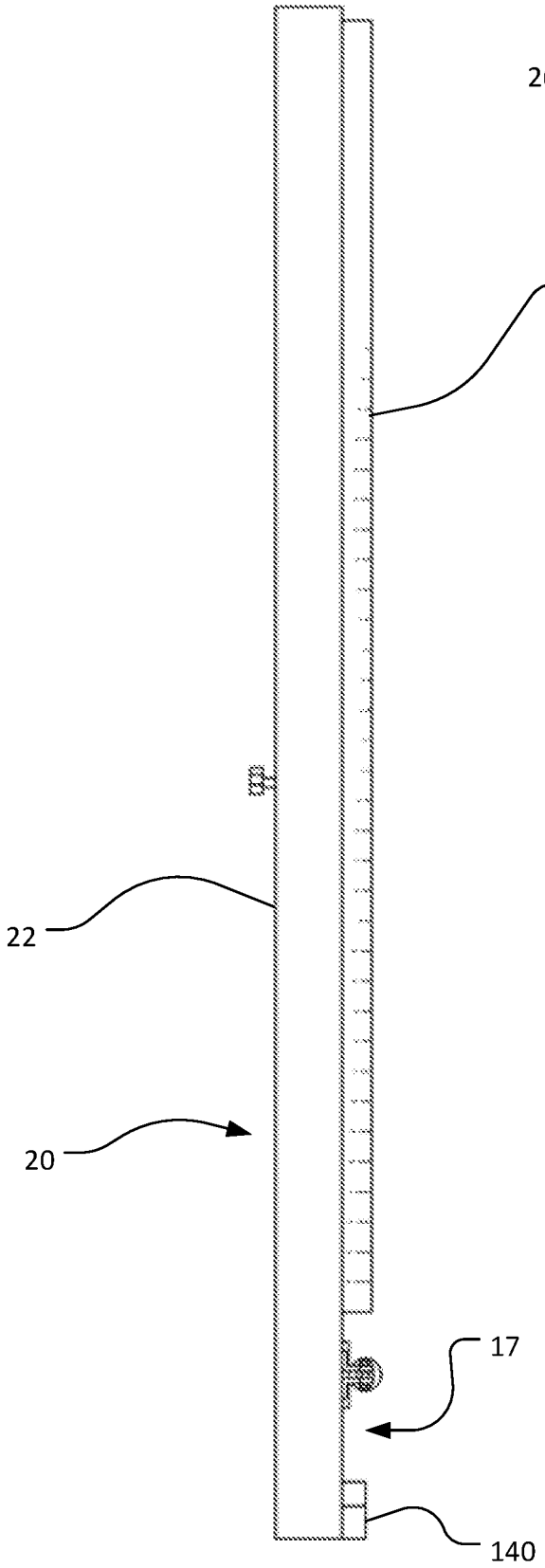
FIG. 4 is a side view of the door of FIG. 1.
Figure 5:
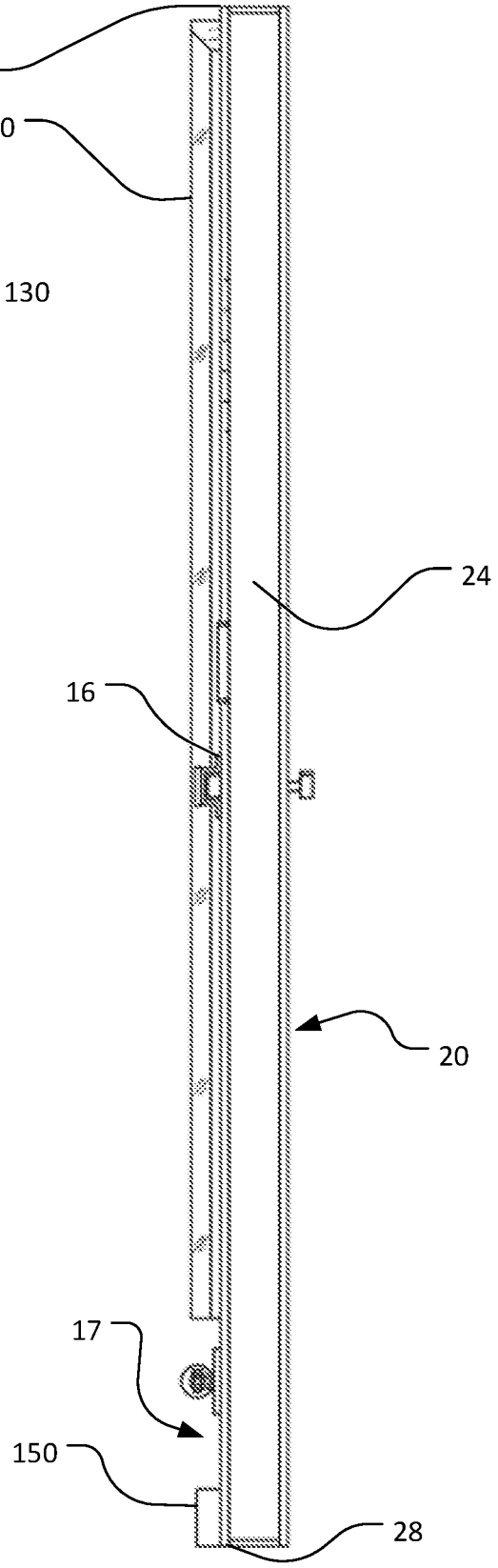
FIG. 5 is another side view of the door of FIG. 1.

The lighting device 130 can be attached to the door 15 the top 26, bottom 28, hinge side 22, and/or the opposing distal side 24. FIGS. 1-8 illustrate various exemplary combinations of lighting devices 130 secured to the door 15. In FIGS. 1-2, the lighting device 130 is configured as a unitary piece that extends along the top 26 and the hinge side 22 of the door 15 in an inverted "L" configuration. In an embodiment, the unitary lighting device 130 may additionally include a portion that extends along the bottom 28 of the door 15 in a "C" configuration. In still another embodiment, the unitary lighting device 130 may include sections that wrap around from the top 26 to the opposing distal side 24, and likewise from the bottom 28 to the opposing distal side.

Figure 6:
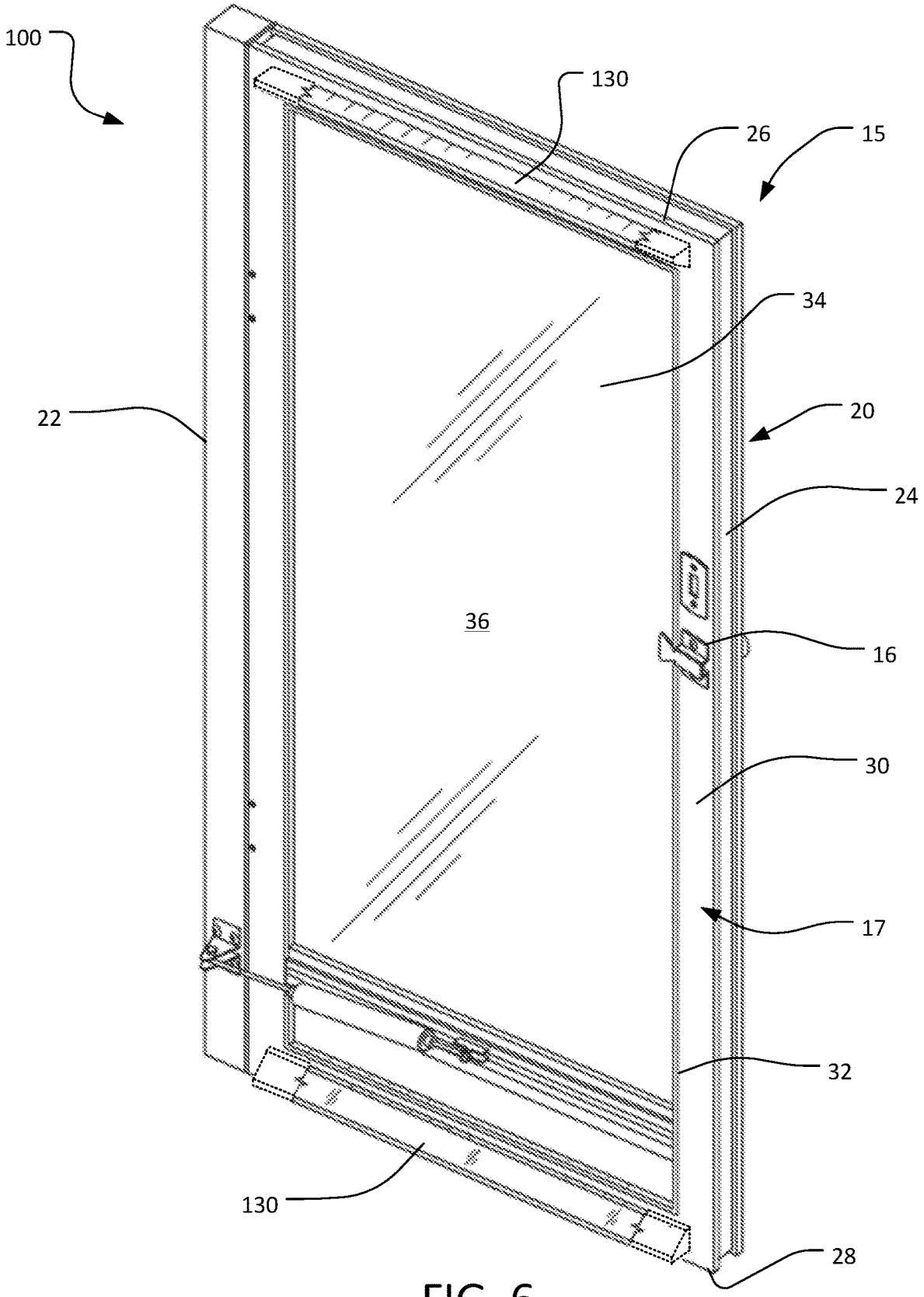
FIG. 6 is a perspective view of an inside surface of a door having a plurality of lighting devices attached thereto according to another embodiment of the invention.
Figure 7:
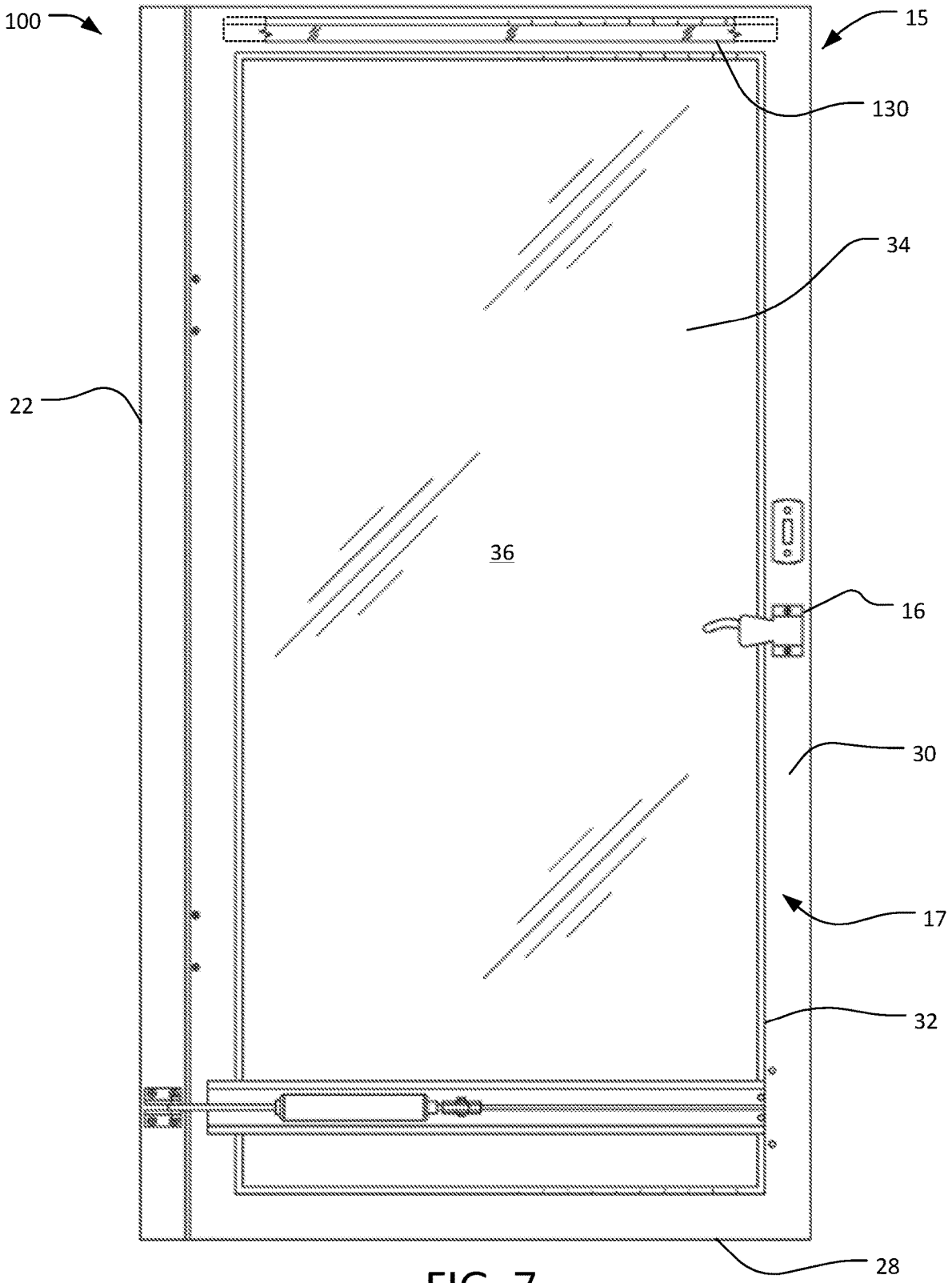
FIG. 7 is a front view of an inside surface of a door having lighting device attached thereto according to still another embodiment of the invention.
Figure 8:
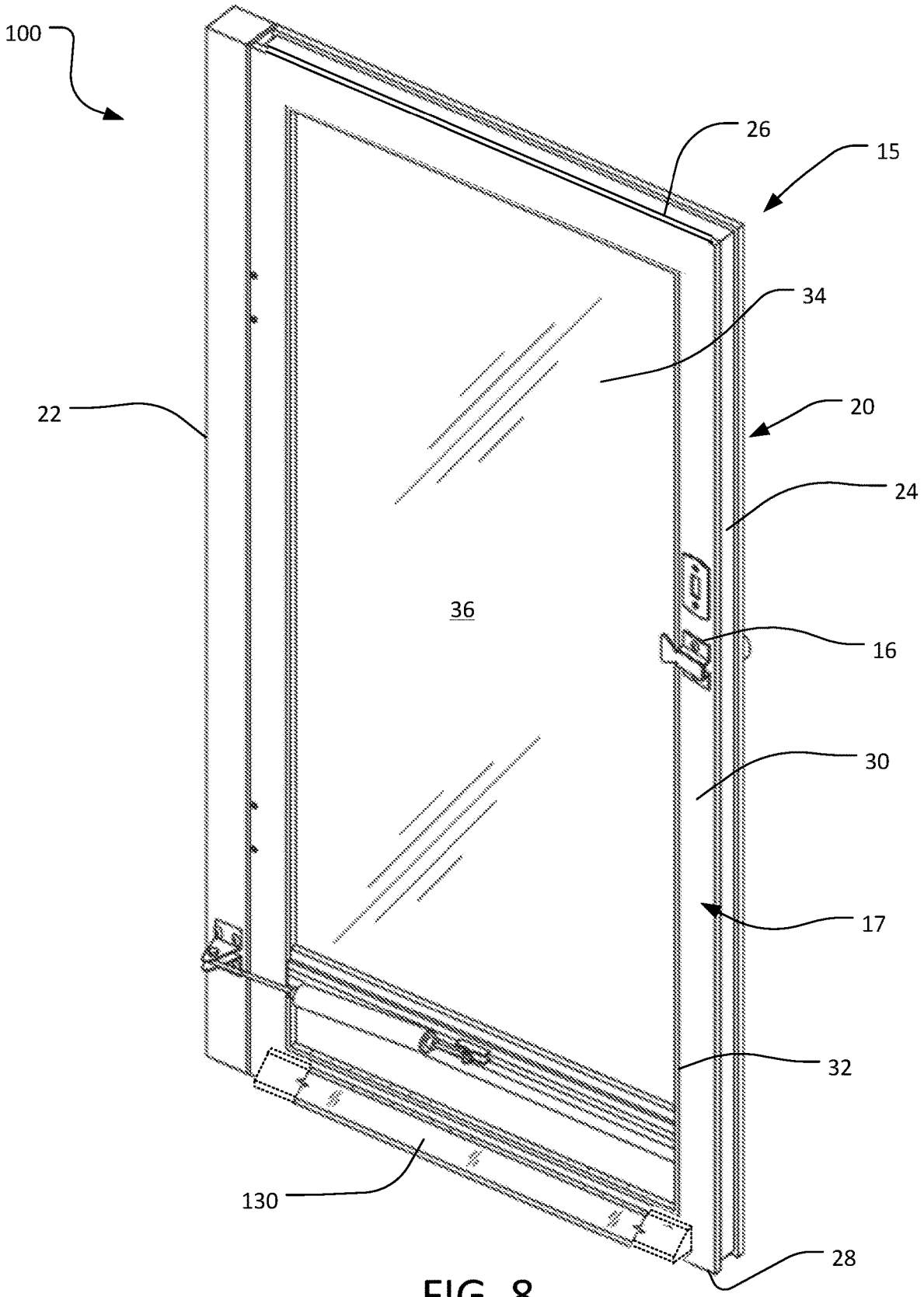
FIG. 8 is a perspective view of an inside surface of a door having a plurality of lighting devices attached thereto according

In FIG. 6, lighting devices 130 are attached to the door 15 at the top 26 and the bottom 28. In FIG. 7, a lighting device 130 is shown only at the top 26 of the door 15, while in FIG. 8, a lighting device 130 is shown only at the bottom 28 of the door 15. Of course, those of skill in the art shall understand that the lighting devices 130 may be disposed on any one or more of the surfaces 22, 24, 26, and 28 of the door 15, at any location that is preferred by the user.

Referring now to FIG. 9, in some embodiments, the door 15 may additionally include a central rail 27 extending between the hinge side 22 and the opposing distal side 24. A lighting device 130 may optionally be secured to the central rail 130. Here, the lighting device 130 can be positioned such that the light-emitting surface 140 is facing up (towards the top 26) or down (towards the bottom 28), as desired. In one embodiment, multiple lighting devices 130 may be secured to the central rail 27. For example, a first lighting device 130 may be positioned to the central rail 27 such that the light-emitting surface 140 faces upwards. A second lighting device 130 may be positioned to the central rail 27 such that the light-emitting surface 140 faces downwards. Accordingly, it may be possible to light an upper section 34*a* of the central portion 34 separately from a lower section 34*b* of the central portion 34 of the door 15, as illustrated in FIG. 10.

Of course, one or more lighting devices 130 may also be placed on the opposing distal side 24 of the door 15. It may be preferable for the lighting devices 130 on the door's opposing distal side 24 to be provided as separate pieces for modular placement so as to avoid the entry mechanisms 16 (e.g., the handle and locks). In other words, a first lighting device 130 may be attached at an upper section of the opposing distal side 24 above the entry mechanisms 16, while a second lighting device 130 may be positioned at a lower section of the opposing distal side 24 below the entry mechanisms 16.

According to an embodiment of the invention, a plurality of lighting devices 130 may be provided as part of a kit. Each of the lighting devices 130 may be manufactured to a standard length (e.g., one-foot sections). Alternately, some sections of light devices 130 may be manufactured to longer lengths than other sections. A user may mix-and-match sections of the lighting devices 130 as desired for placement around the perimeter 30 and/or the central rail 27 of the door 15.

The lighting devices 130 may be secured to the door 15 with any adhesive whether now known or later developed. It may be preferred that the adhesive is robust to withstand potentially harsh conditions, such as considerable changes in the temperature. It may also be preferred that the adhesive is non-permanently bonding, such that lighting devices 130 may be removed from the surface(s) of the door 15 as desired and/or as is necessary. To effectuate such removal from the door 15, each lighting device 130 may be equipped with a flange or other structure that allow the user to easily remove the lighting device 130 from the door 15. In still another embodiment, the lighting devices 130 may be secured to the door 15 with fasteners, such as rivets, screws, or other fasteners now known or later developed.

The lighting devices 130 may be powered by any means now known or later developed, including but not limited to self-power, solar-power, battery power, electrical power, et cetera. In an embodiment, the lighting devices 130 are wired to a battery 140. The battery 140 may be rechargeable. In another embodiment, the lighting devices 130 may be hard wired to a power source within the building to which the door 15 is attached.

A controller 150 controls operation of the lights 145. The controller 150 may be equipped with programming for controlling the brightness, color, state, and/or other characteristics of the lights 145. In one embodiment, the programming includes one or more modules or routines that run various different pre-programmed lighting events. Each lighting event may include a set of instructions for modulating the color, intensity, and/or state of each light 145. For example, according to one module, the programming may cause the lights 145 to flash at a predetermined interval (e.g., every 2 seconds, every second, every millisecond, 10 milliseconds, 100 milliseconds, etc.). The lights 145 may be configured for only one color (e.g., "white" light, or any other color), and one intensity, and may be actuated individually or as a group, or set of groups. For example, when the lights 145 are actuated as a group, when the lights 145 are "on," all the lights 145 are on at a uniform intensity, and when the lights 145 are "off," all of the lights 145 are off. When the lights are actuated as set of groups, a first set of lights 145 (e.g., every other light 145) may be actuated while a second set of lights 145 (e.g., the remainder of the lights 145) remain off. When the first set of lights 145 are turned off, the second set of lights 145 may then be actuated. Other groupings of lights 145 are also contemplated within the scope of the invention.

The controller 150 may additional be programmed to change the color of the lights 145 where the lights 145 are so equipped. Here, the lights 145 may be preprogrammed to cycle through the available colors based on a time interval, for example. In embodiments, the lighting devices 130 contain a plurality of lights 145, and the plurality of lights 145 may include lights 145 having different color changing capabilities. Certain lights 145 may be actuated to display a preferred color (e.g., red, blue, green, etc.) while the other lights 145 remain off.

The controller 145 may also be programmed to change the intensity of the lights 145 (if the lights 145 are so equipped). The intensity can be controlled according to a predetermined pattern, similar to what is described above. Alternately, the intensity may be automatically altered based on sensory information. For example, the lighting devices 130 may be in communication with one or more sensors (e.g., a motion sensor). When the area around the sensor is generally still, the lights 145 may be programmed to remain at a lower intensity (or even off). When the sensor detects movement near the lighting devices 130, the controller 150 may cause the intensity of the lights 145 to increase.

In one embodiment, the lighting devices 130 may be in communication with an audio sensor. When the audio sensor picks up sound, the controller 150 may activate one or more of the lights 145 in the lighting device(s) 130. In one example, the programming may determine that the audio is from a song, and alter the modulation of the lights 145 based on the beat of the song.

According to a further embodiment, the controller 150 may sync with a user's device, such as a mobile device, for altering the intensity, color, state, and/or other characteristics of the lighting devices 130. The user may interact with his or her phone in order to turn the intensity of the lights 145 up or down, to switch the color emanating from the lighting devices 130, to select a particular program for modulation of the lights 145 (e.g., a soft cycling of the lights 145 through the various available colors, a slow flashing of the lights 145, a fast blinking of the lights 145, etc.) A combination of programming may be selected. For example, the user may desire that the lights 145 both vacillate in intensity and change colors. Accordingly, the controller 150 may be equipped with programming that allow for multiple modules to be accessed at once in order to alter the operation of the lighting devices 130.

Figure 12:
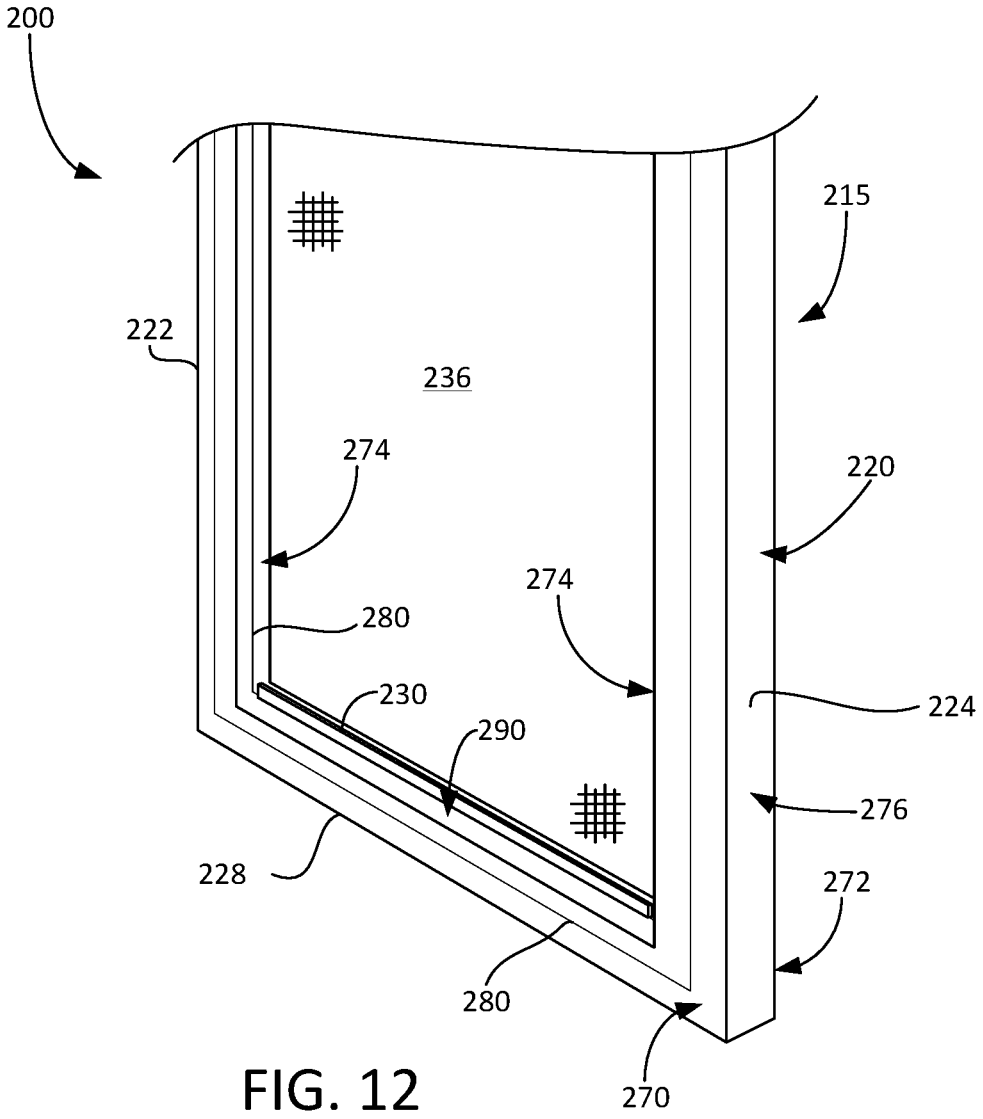
FIG. 12 is a perspective view of a lighted door system according to embodiments of the invention.

FIG. 12 illustrates a lighted door system 200 which is similar to the lighted door system 100 except as shown and described herein. Those of skill in the art will appreciate that the embodiment 100, and thus the embodiment 200, may be modified in various ways, such as through incorporating all or part of any of the various described embodiments, for example. For uniformity and brevity, reference numbers between 200 and 399 may be used to indicate parts corresponding generally to those discussed above numbered between 0 and 199, though with any noted or shown deviations.

In embodiment 200, a door 215, such as a screen door or storm door for a recreational vehicle (RV) has a frame 220 comprising hinge side 222, an opposite distal side 224, a top (not shown), and a bottom 228. The frame 220 may be formed of aluminum tubing, although other materials may optionally be used. In an embodiment, the frame 220 is formed of square tubing thereby defining a front face 270, an opposing back face 272, and an inside face 274, and an outer face 276. The frame 220 may be configured to receive a screen or transparent panel 236 to form a planar face of the door 215. In one embodiment, an edge of the screen is at least partially inserted into a groove 280 formed into the front face 270 of the frame. The opposing back face 272 of the frame 220 may additionally have a groove 280 for receiving a screen, although this is not required. Additionally, the side faces 274 of the frame may, but need not, have a groove 280 formed therein. In some cases, the frame 220 may be separated into a first portion (e.g., top) and a second portion (e.g., bottom), for example, by a frame member disposed between the hinge side 222, the opposite distal side 224, the top and/or the bottom 228 of the frame 220. In a preferred embodiment, either the front face 270 or the opposing back face 272 of the frame 220 is free of grooves 280 and any other extraneous material. With the screen in place in the frame 220, the opposing back face and opposing side faces form a ledge or lip 290.

Lighting devices 230 may be coupled to the ledge 290 of the door frame 220, and as described herein, may be secured at least partially within a groove 290 in the ledge 290. The lighting devices 230 are preferably LED lights, but other lights may be used. One color of lights may be used, or multiple colors of lights may be used. The lighting devices 230 may include an extruded housing 231 configured to attach to the ledge 290 of the door frame 220. In one embodiment, shown in FIGS. 13A, 13B, 14A, and 14B, the extruded housing 231 includes a flange 232 or clip for engaging with the door frame 220, and more specifically, one of the grooves 290 in the door frame 220, as is described herein.

Figure 14A:
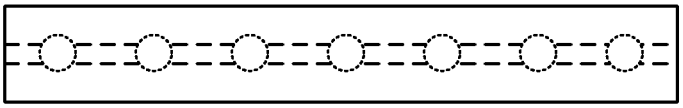
FIG. 14A is a front view of a lighting device for a lighted door system according to another embodiment of the invention.
Figure 14B:
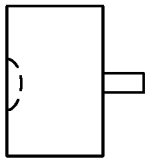
FIG. 14B is a side view of the lighting device of FIG. 14A.

It is preferred that the lighting devices are disposed on one or more respective inside faces 274, leaving the opposing back face 272 and the front face 270 of the frame 220 devoid of lighting devices 230. By disposing the lighting devices to the opposing side faces, it may be possible to protect the lights from undesirable contact with, for example, an outside door. However, lighting devices 230 may be disposed on the opposing back face 270 and/or the front face 272 of the frame 220. FIGS. 14A and 14B illustrate an embodiment of a lighting device 230 that includes a flange 232 extending from a back face of the lighting device 230. The flange 232 may be inserted into the groove 280 in the front face 270 and/or the opposing back face 272 such that the lights 233 shine away from the door frame 220.

Figure 13A:
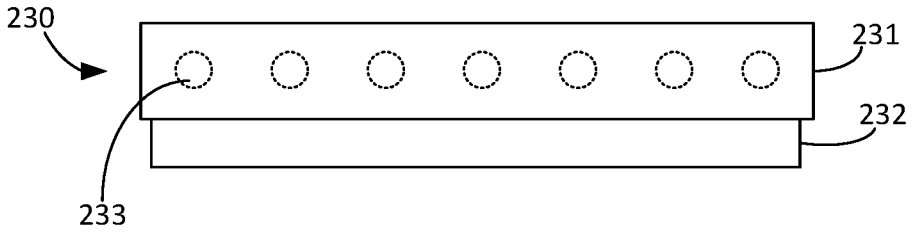
FIG. 13A is a front view of a lighting device for a lighted door system according to an embodiment of the invention.
Figure 13B:
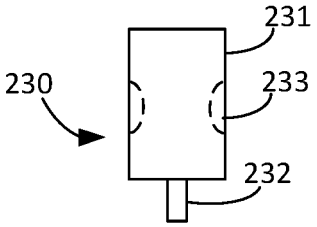
FIG. 13B is a side view of the lighting device of FIG. 13A.

In embodiments where the inside faces 274 of the frame 220 have a groove 280, an extruded lighting device 230 is configured to be coupled to the frame 220 via a clip or flange 232 which may be inserted into the groove 280 as illustrated in FIGS. 13A and 13B. Here, lights 233 may be disposed in the housing 231 to provide light in opposing directions.

Where the inside faces 274, the front face 270 and/or the opposing back face 272 of the frame 220 do not have a groove 280, the extruded lighting device 230 may be alternately configured to couple to the frame 220. For example, the flange 232 may be configured as a clip to fit around the frame 220 to secure the lighting device thereto. In still another alternate embodiment, the lighting device 230 may be adhered to the frame 220, e.g., via a mechanical fastener such as a screw or rivet, or via an adhesive.

It may be desirable for the lights to be positioned at an angle relative to the opposing side faces. In an embodiment, the lighting device 230 is substantially similar to lighting device 130, with the optional addition of a flange 232 and/or clip as is necessary. The lighting device 230 may be coupled to the frame 220 such that the lights 233 shine outward (e.g., away from the structure) or such that the lights 233 shine inward (e.g., towards the structure). When oriented such that the lights 233 shine outward from the door 215, the lights 233 may illuminate the outside environment around the door 215. This may be particularly useful where the RV is raised above the ground and a user must traverse stairs in order to enter the RV, for example. When oriented such that the lights 233 shine inward, the lights 233 may illuminate an area inside of the RV so as to alert occupants as to the location of the exit, for example. In one embodiment, the lighting device(s) 230 may be coupled to the frame 220 such that lighting is provided in both the outward and inward directions relative to the door. For example, lights 233 that shine outward may be coupled to one or more inside faces 274 of the frame 220 (e.g., the inside faces 274 of the hinge side 222 and the opposing distal side 224). Lights 233 that shine inward may be coupled to the inside faces 274 of the frame 222 corresponding to the top and bottom 228 of the door 215.

As is described regarding the lighting system 100, in embodiments of system 200, sensors may be disposed at or near the frame 220. The sensors may be in communication with the lights 233 such that, upon sensing a predetermined condition, the lights 233 may be turned on, off, caused to change color, flash, etc. For example, in one embodiment, motion or proximity sensors may be particularly desirable. When the sensor(s) determines the presence of a person, or movement of an object, the lights 233 may be activated. When the sensor determines that the person is no longer in the vicinity, or the sensor has not detected movement for a predetermined period of time (e.g., 5 minutes, 10 minutes, 30 minutes, etc.) then the lights 233 may be deactivated. Other sensors may additionally, or alternately, be incorporated into use with the lighting system as described herein. In embodiments, sensors may activate alerts such as audible alarms.

In some embodiments, the lighting device 230 is configured to communicate, e.g., over a network, with a mobile device. The lighting device 230 may be equipped with a processor, memory, an input/output device, and a networking device. Likewise, the mobile device may be equipped with a processor, memory, an input/output device, and a networking device. The mobile device may be a personal device such as a phone or tablet, or a second lighting device, such as a lighting device disposed on another RV. The respective memories may be equipped with instructions that allow a user to communicate with the lighting device, or for the lighting device to communicate directly with the mobile device (e.g., another lighting device).

The mobile device may but need not be a phone. RVs are often parked in locations that are obscured by other RVs. Therefore, it can be difficult to easily locate the correct RV. This may be especially true for visitors. The mobile device may be configured to communicate with the lighting device 230 to authenticate the identity of the mobile device and to activate the lighting device 230 if the user's identity is authenticated. For example, a user may access a program on his or her mobile device that communicates with programming on the lighting device 233 to activate the lights such that the user can identify the correct RV. A user, via a mobile device, may be able to control the color of the LEDs activated, the flashing pattern, the intensity of the lights, etc.

In other embodiments, the mobile device may be a second lighting device 230. Here, the lighting devices 230 may be in communication with each other for the purpose of providing a seamless lighting experience for users within a predetermined proximity, or for the purpose of communicating with a user, among other reasons. The respective lighting devices 230 may be configured to communicate with each other within a predetermined radius (e.g., 3 feet to 0.25 miles). When two or more lighting devices 230 are within the predetermined radius, information may freely flow between the lighting devices 230 to provide lights and/or alerts to nearby users. For example, multiple RVs may be parked in a lot. In one embodiment, multiple RVs are parked in a lot in a line such that the doors face generally in the same direction. When a user begins to walk near a first door, a proximity sensor or motion detector may determine the presence of the user and activate the lighting device(s) 230 disposed on the first door 215. When the lights 233 on the first door 215 are activated, a signal may be sent to the lights on a second door 215 (e.g., a second door in the direction of travel of the user as determined by a motion detector) such that the lights 233 are activated on the second door prior to arrival of the user. The walking path of the user may thus be illuminated as the user moves from one location to another.

In another example, RVs may be in close proximity during transport (e.g., on roadways). The lighting devices 230 may be configured to communicate with one another to provide a driver with an alert that the RVs are dangerously close. In embodiments, sensors may be configured to identify objects near to the door 215 and provide an alert to the user.

Many different arrangements of the various components depicted, as well as components not shown, are possible without departing from the spirit and scope of the invention. Embodiments of the invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the invention. It will be understood that certain features and subcombinations are of utility and may be employed without reference to other features and subcombinations and are contemplated within the scope of the claims. The specific configurations and contours set forth in the accompanying drawings are illustrative and not limiting. Some steps may be performed in different orders that described herein.

The invention claimed is:

1. A lighted door system, comprising:

a door having a frame defining a hinge side, an opposite distal side, a top, and a bottom, wherein the frame comprises a front face, a back face, and inside face, an outside face, and a groove formed in at least one of the front face, the back face, the inside face, and the outside face;

at least one lighting device coupled to the door frame, wherein the at least one lighting device comprises a housing and a flange extending from the housing; and wherein:

the flange is received into the groove to couple the at least one lighting device to the door frame; and the housing and flange of the lighting device are formed from a single piece of material.

2. The system of claim 1, wherein the housing comprises a first leg extending perpendicularly from a second leg in a generally "L" configuration, and a light-emitting surface extending at an angle between the first and second leg; wherein the angle of the light-emitting surface is angled between thirty-five and fifty-five degrees.

3. The system of claim 2, wherein the angle of the light-emitting surface is about forty-five degrees.

4. The system of claim 3, wherein the flange extends from the first leg of the housing.

5. The system of claim 3, wherein the flange extends from the second leg of the housing.

6. The system of claim 1, wherein the flange extends from a bottom surface of the housing.

7. The system of claim 1, wherein the flange extends from a side surface of the housing.

8. The system of claim 1, wherein the groove in the frame is formed in the inside face thereof.

9. The system of claim 8, wherein:

the at least one lighting device comprises two lighting devices;

a first lighting device is coupled to the inside face of the frame at the hinge side thereof;

a second lighting device is coupled to the inside face of the frame at the opposing distal side thereof; and the inside face of the frame at the top and bottom thereof are devoid of lighting devices.

10. The system of claim 1, wherein the groove in the frame is formed in the front face thereof.

11. The system of claim 10, wherein:

the at least one lighting device comprises two lighting devices;

a first lighting device is coupled to the front face of the frame the top side thereof; and a second lighting device is coupled to the front face of the frame at the hinge side or the opposing distal side thereof.

12. The system of 10, wherein:

the at least one lighting device comprises two lighting devices;

a first lighting device is coupled to the front face of the frame at the top side thereof; and a second lighting device is coupled to the front face of the frame at the bottom side thereof.

13. The system of claim 10, further comprising a second groove formed into the back face of the frame.

14. The system of claim 13, wherein:

the at least one lighting device comprises two lighting devices;

a first lighting device is coupled to the front face of the frame; and a second lighting device is coupled to the back face of the frame.

15. The system of claim 1, wherein the frame further comprises a central rail, the central extending from the hinge side to the distal side, and wherein a second lighting device is coupled to the central rail.

16. The system of claim 1, further comprising at least one sensor operatively coupled to the at least one lighting device.

17. A lighted door system, comprising:

a first door having a frame and at least one lighting device fixed to the first door frame; and a second door having a frame and at least one lighting device fixed to the second door frame;

wherein:

the first door and the second door are spatially separated;

the lighting device fixed to the first door frame is communicatively coupled to the lighting device fixed to the second door frame;

the frame of each of the first door and the second door has a groove formed therein;

each lighting device comprises a housing having a flange extending therefrom; and the flange of the lighting device is received into the respective groove for fixing the respective lighting device to the respective door frame.

18. A method for lighting an area near a door, comprising:

providing a door having a frame defining a hinge side, an opposite distal side, a top, and a bottom;

providing a groove formed in the door frame;

providing at least one lighting device comprising a housing and a flange extending from the housing;

positioning the at least one lighting device at the door frame by inserting the flange into the groove; and selectively activating the lighting device to illuminate the area near the door;

wherein the housing and flange of the lighting device are formed from a single piece of material.

* * * * *